US006438330B1

(12) United States Patent
Itoh

(10) Patent No.: US 6,438,330 B1
(45) Date of Patent: Aug. 20, 2002

(54) IMAGE FORMATION APPARATUS, IMAGE FORMATION UNIT AND TONER STIRRING UNIT

(75) Inventor: Toshiyuki Itoh, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/779,567

(22) Filed: Feb. 9, 2001

(30) Foreign Application Priority Data

Aug. 15, 2000 (JP) ..... 2000-246447

(51) Int. Cl.[7] ..... G03G 15/08; G03G 21/00

(52) U.S. Cl. ..... 399/27; 399/61; 399/99; 399/256

(58) Field of Search ..... 399/27, 61, 63, 399/98, 99, 254, 256

(56) References Cited

U.S. PATENT DOCUMENTS 5,317,369 A * 5/1994 Nakanishi ..... 399/27
5,383,007 A * 1/1995 Kinoshita et al. ..... 399/65
5,436,704 A * 7/1995 Moon ..... 399/256
6,148,156 A * 11/2000 Matsumoto ..... 399/27 X

FOREIGN PATENT DOCUMENTS

| | | |
|---|---|---|
| JP | 04-242275 | * 8/1992 |
| JP | 04-311980 | * 11/1992 |
| JP | 9-15953 | 1/1997 |
| JP | 10-268623 | * 10/1998 |
| JP | 2000-155461 | * 6/2000 |

* cited by examiner

*Primary Examiner*—Sophia S. Chen

(57) ABSTRACT

This invention relates to a device for detecting when the magnetic toner in the developing unit of an image formation device is empty, and prevents erroneous detection of empty toner even when the fluidity of the magnetic toner becomes poor. The developing device (3) has a stirring unit (30) having a cleaning member (22) for cleaning the position of a toner sensor (10), a toner accumulation section (24), and a magnetic metal member (21). The magnetic metal member (21) and toner accumulation section (24) for preventing erroneous detection of the toner-empty alarm are located at the sensor position of the stirring unit, so it is possible for the toner sensor to synthetically generate output that toner is detected, and thus making it possible to prevent erroneous detection that the toner is empty.

14 Claims, 12 Drawing Sheets

| Process Speed | Sensor Sampling Interval | Empty Detection Interval | The Number of Detection per One Cycle |
|---|---|---|---|
| 92.2 mm/s | 10 ms | 792 ms | 79 |

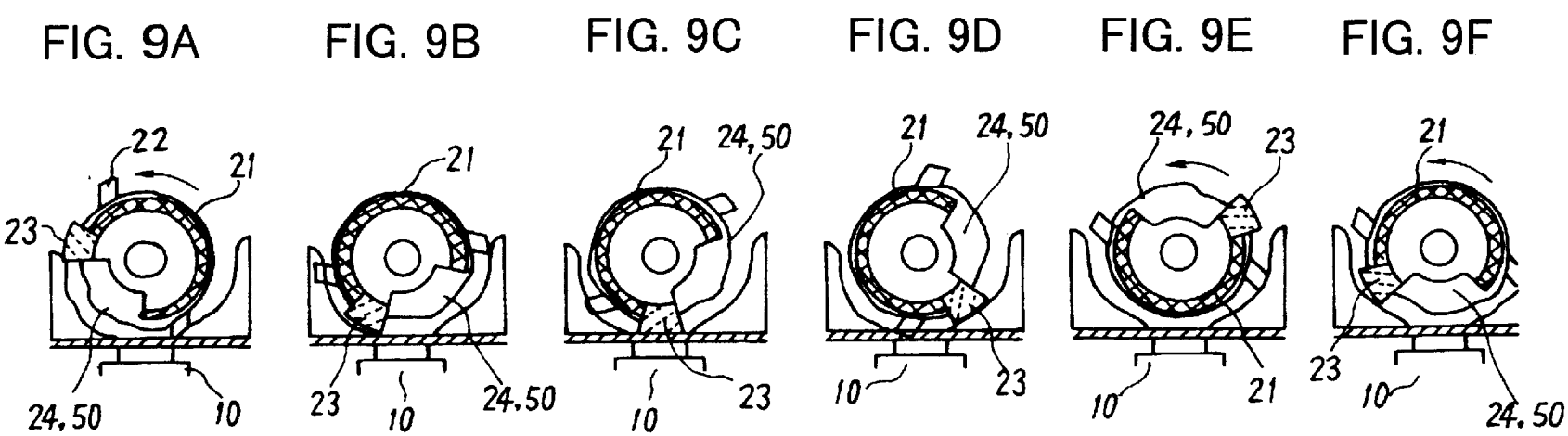
FIG. 9A
FIG. 9B
FIG. 9C
FIG. 9D
FIG. 9E
FIG. 9F
21
22
23
24, 50
10
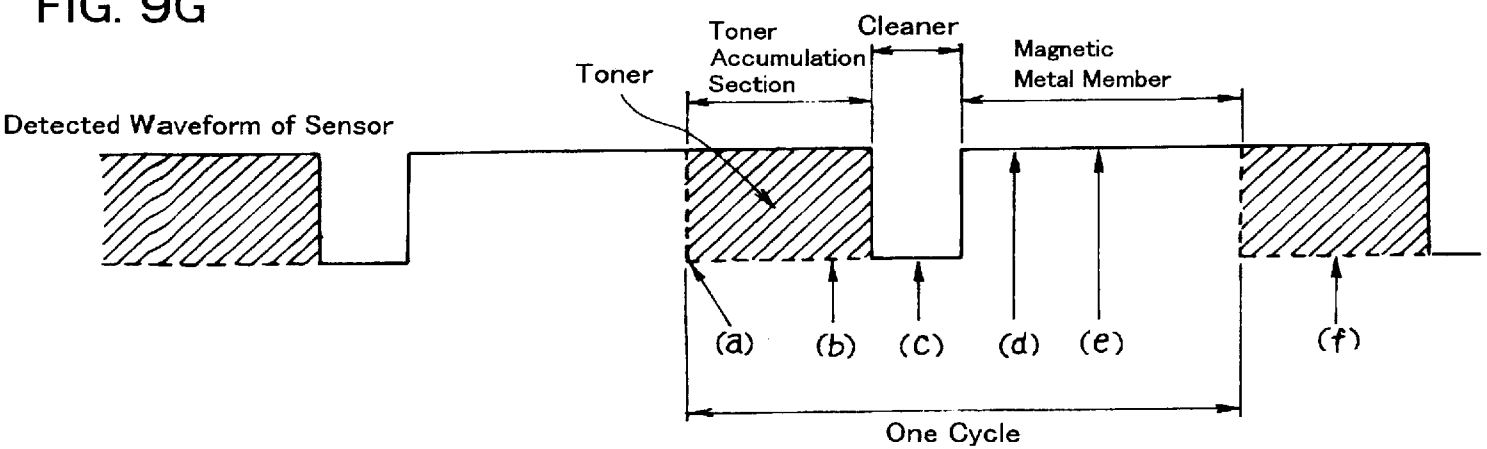
FIG. 9G
Detected Waveform of Sensor
Toner
Toner Accumulation Section
Cleaner
Magnetic Metal Member
(a)
(b)
(c)
(d)
(e)
(f)
One Cycle

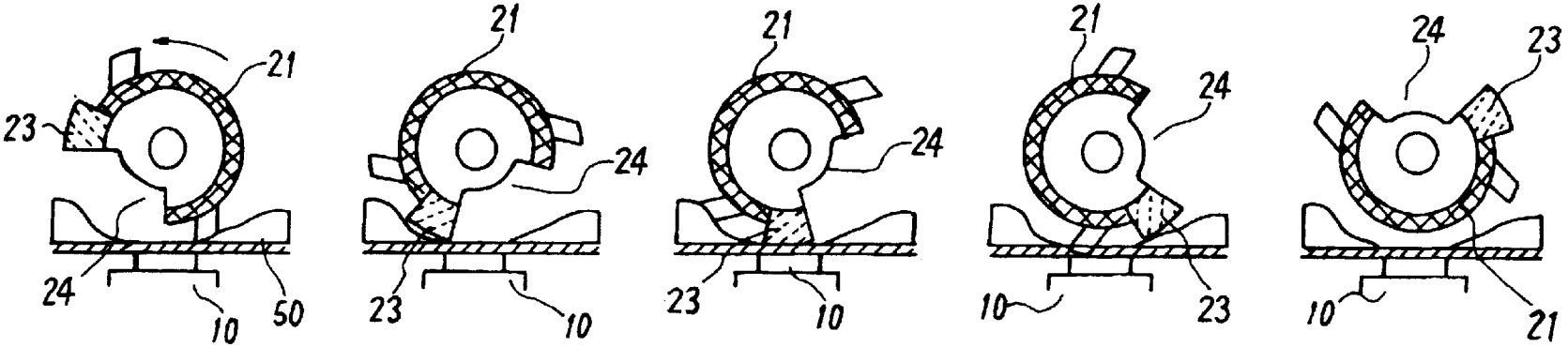
FIG. 10K
FIG. 10M
FIG. 10N
FIG. 10P
FIG. 10Q
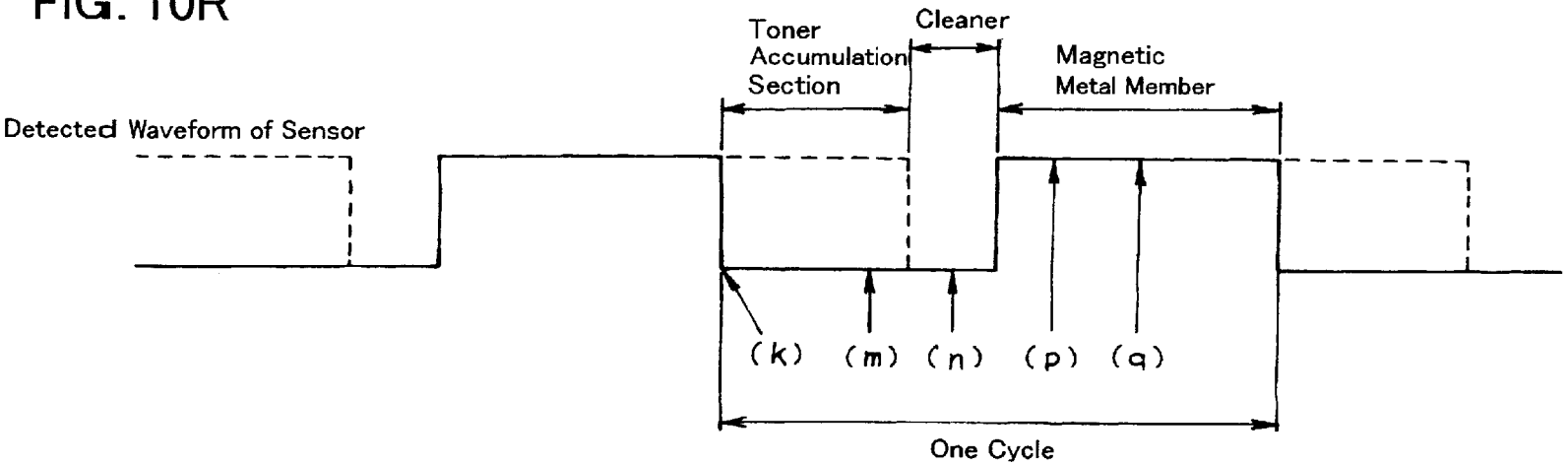
FIG. 10R

Prior Art
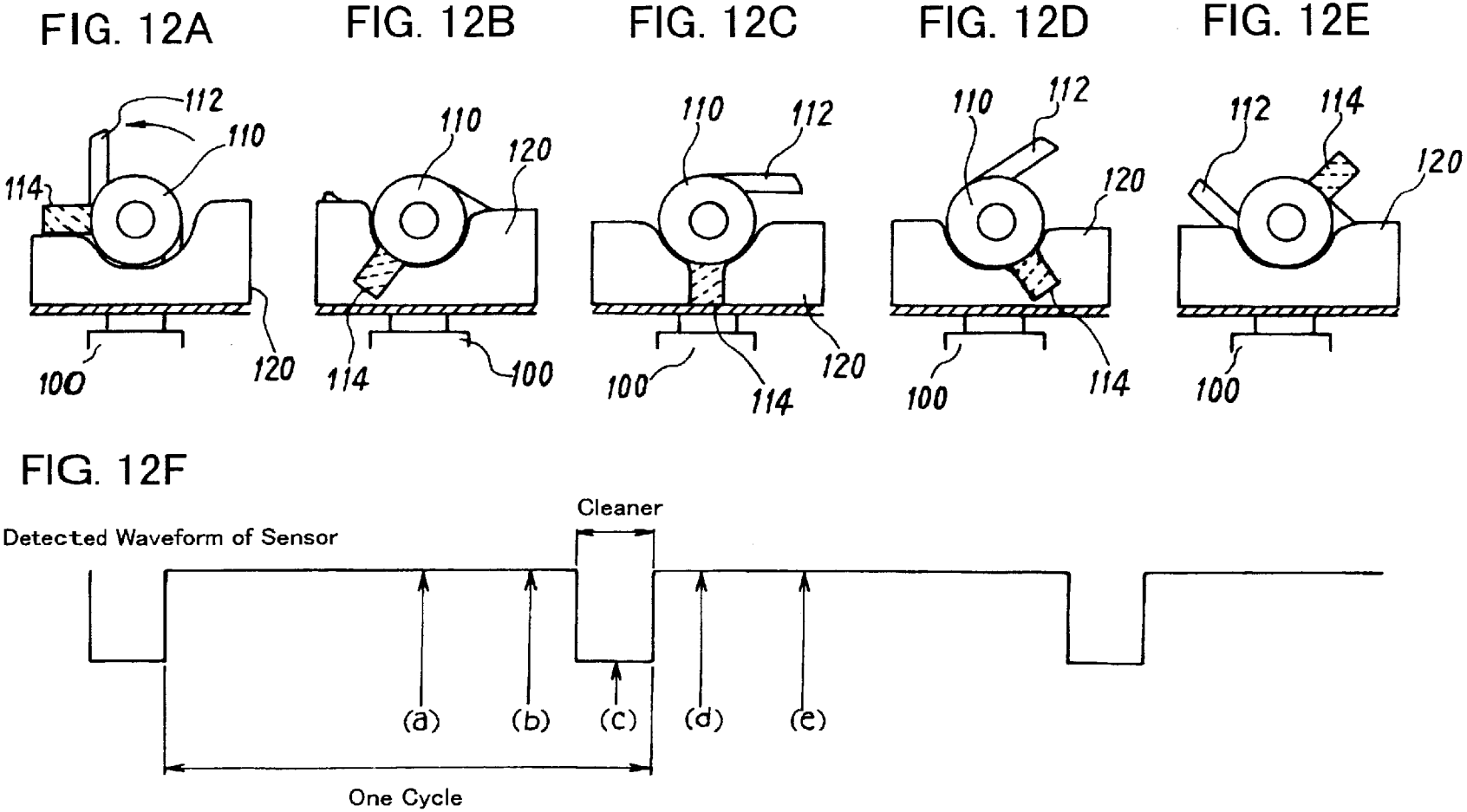

Prior Art
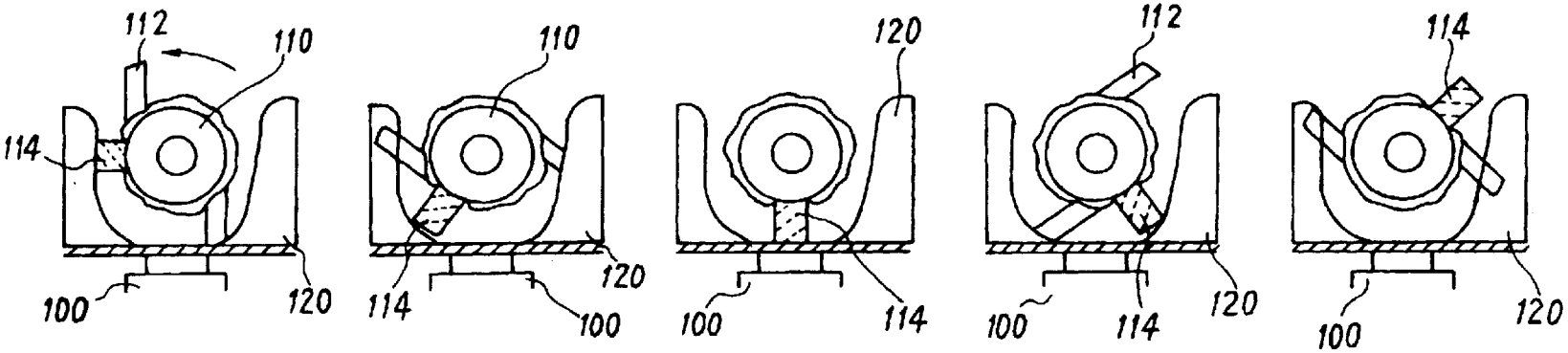
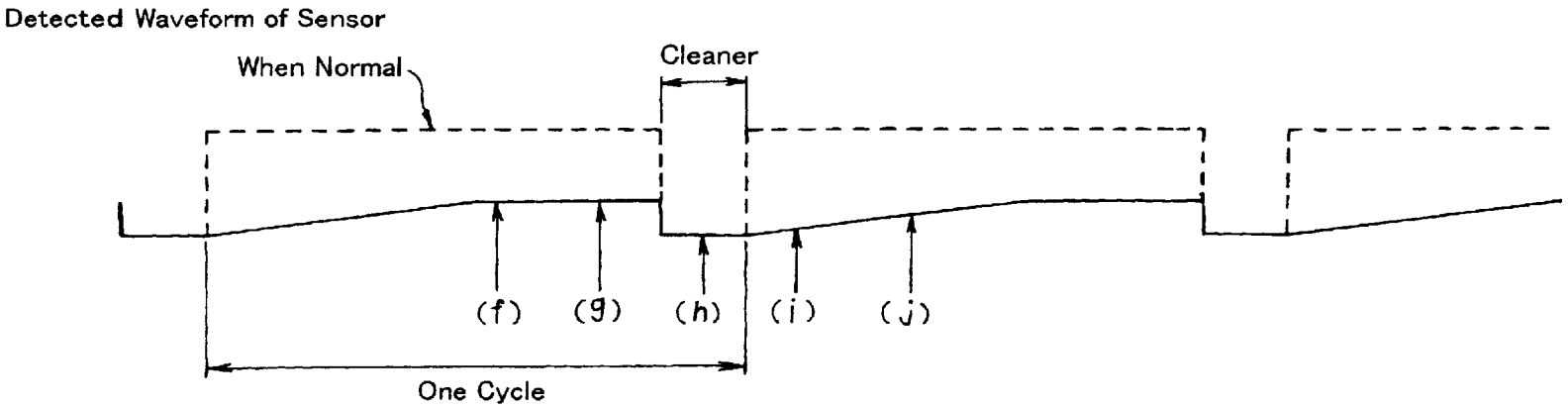

IMAGE FORMATION APPARATUS, IMAGE FORMATION UNIT AND TONER STIRRING UNIT

BACKGROUND OF THE INVENTION

1. Field of the Invention

This invention relates to an image formation apparatus of a printer, facsimile, copier or the like that uses magnetic toner to form an image, and more particularly to an image formation apparatus, image formation unit and toner mixing unit that is capable of detected the amount of remaining toner.

2. Description of the Related Art

An image formation device forms an electrical latent image on a latent image carrier such as a photosensitive drum, and develops the latent image with toner, then forms a visible image on a sheet by a process of transferring the toner image to a sheet. A developing unit is provided to the printing unit of the image formation apparatus, and a developing roller and a toner-stirring unit are provided to the developing unit.

The developing roller feeds the toner inside the developing unit to the photosensitive drum. The toner stirring unit stirs the toner inside the toner-supply chamber that is connected to the developing chamber, charges the toner, and breaks up any hard toner. This toner is consumed when printing the image. Therefore, when the amount of toner remaining becomes low, it is necessary to supply new toner. In order to automatically detect when the amount of toner is low, there is a toner empty mechanism.

FIGS. 12A to 12F are drawings explaining a conventional toner empty mechanism. A magnetic sensor 100 is located below the developing unit. The magnetic sensor 100 detects the magnetic force of the magnetic toner 120, and generates a detection signal. In part of the stirring element 110 there are stirring blades 112 and a cleaning member 114 made of pliable urethane foam or a rubber blade for wiping toner off of the sensor 100 that detects the residual toner. As this stirring element 110 rotates, the control circuit periodically detects whether or not there is toner in the location of the sensor 100 with the sensor 100, and determines, according to the number of detection times, whether or not to generate a toner empty alarm. FIGS. 12A to 12E shows movements of toner for normal toner flow, and FIG. 12F show the detection waveform of the toner sensor. In FIG. 12F, points (a) to (e) indicate the detection waveform as stirring element 110 rotates. Points (a) to (e) correspond to the stirring element 110 rotary positions depicted in FIG. 12A to FIG. 12E respectively.

As shown in FIG. 12A and FIG. 12B, before the cleaner 114 of the stirring unit 110 passes the position of the sensor 100, the toner normally flows from the rear left to the right, and the waveform of the sensor 100 is high level indicating that there is toner. As shown in FIG. 12C, when the sensor cleaner 114 approaches the position of the sensor 100, the waveform level of the sensor 100 falls. As shown in FIG. 12D and FIG. 12E, after the sensor cleaner 114 has cleaned the position of the sensor 100, toner normally flows from the rear left to the right, and the waveform of the sensor 100 is high level indicating that there is toner.

Moreover, the sensor 100 detects at a fixed cycle whether or not there is toner flowing to the position of the sensor 100, and the control circuit can determine whether or not to generate a toner-empty alarm according to the number of detections.

When the printing operation is performed over a long period of time with little toner consumption, the toner is consumed a very little at a time. Therefore, the toner is stirred for a long time in the printing unit (developing unit), and thereby cutting into an external additive to the toner such as silica for increasing fluidity, the fluidity of the toner extremely worsens.

In that case, the toner with decreased fluidity accumulates in the printing unit in the part other than where the stirring unit 110 is, thereby the cavity of the toner occurs at the sensor position of the stirring unit 110, causing a condition of reduced residual toner in the sensor position. Due to this, the toner sensor 100 detects that the amount of residual toner is low and generates a toner-empty alarm.

FIGS. 13F to 13K are drawings explaining the problems with the related art. The movement of the toner when the fluidity of the toner becomes poor is shown in FIG. 13F to FIG. 13J, and the detection waveform of the toner sensor is shown in FIG. 13K. FIG. 13F and FIG. 13G show the state before the sensor cleaner 114 passes the position of the sensor 100, and FIG. 13H shows the state when the sensor cleaner 114 approaches the position of the sensor 100 and when the level of the waveform drops. As shown in FIG. 13I and FIG. 13J, the sensor cleaner 114 cleans the position of the sensor 100, however, since the fluidity of the toner 120 become poor and the toner 120 does not break up, cavities occur and the toner 120 build up and hardens in the stirring unit 110.

When the fluidity of the toner becomes poor in this way, the toner does not flow smoothly to the sensor position even though there is plenty of toner, and the toner 120 builds up and hardens in the stirring unit 110 and the sensor 100 is not able to detect the toner and thus generates a toner-empty alarm.

When a toner-empty alarm is generated, the user must fill the toner according to the manual regardless of whether there is toner in the printing unit. However, in that case, since more toner than is necessary is filled inside the printing unit, the build up of toner further increases, and the hollow cavities increase, thus a toner-empty alarm is mistakenly detected again.

When used under the above conditions, abnormal pressure occurs inside the printing unit, trouble such as blown toner or toner leakage occurs, causing problems in printing.

SUMMARY OF THE INVENTION

An objective of this invention is to provide an image formation apparatus, image formation unit and toner stirring unit for accurately detecting when toner is empty even when fluidity of the magnetic toner decreases.

Another objective of this invention is to provide an image formation apparatus, image formation unit and toner stirring unit in which a sensor accurately detects whether or not there is not even when fluidity of the magnetic toner decreases.

In order to accomplish these objectives, the image formation apparatus and image formation unit of this invention comprises: a developing unit for developing a latent image on the latent image carrier with magnetic toner; and a toner sensor for detecting whether or not there is magnetic toner in the developer. The developing unit comprises: cleaning member for cleaning the position of the toner sensor, and a stirring unit having a toner accumulation part and a magnetic metal member.

In this invention, the magnetic metal member for preventing erroneous detection of the toner empty alarm, and toner accumulation part are provided at the position of the sensor of the stirring unit, so the toner sensor can generate output of detecting the toner even when the fluidity of the magnetic toner is poor, thus it is possible to prevent erroneous toner empty detection. Therefore, there is no erroneous detection of the toner empty alarm, making it possible to prevent toner from being over supplied, as well as prevent toner from being blown out or leaking, and thus normal printing is possible. Also, since the residual toner is properly managed, it is possible to consume toner without wasting any.

Moreover, in this invention, the apparatus or the unit further have a control circuit for detecting when the toner is empty from the output of the toner sensor after one turn of the stirring unit. Therefore, it is possible to accurately detect when the toner is empty even when there is a cleaning unit.

Furthermore, in this invention, the toner accumulation part is located in one area around the rotating shaft of the stirring unit, and the magnetic metal member is provided to another area around the rotating shaft of the stirring unit. Therefore, it is possible for the toner sensor to more accurately generate output of the synthetically detected toner.

BRIEF DESCRIPTION OF THE DRAWINGS

FIGS. 9A, 9B, 9C, 9D, 9E, 9F and 9G are drawings explaining the toner-empty detection operation of an embodiment of the invention when the fluidity of the toner is poor.

FIGS. 10K, 10M, 10N, 10P, 10Q and 10R are drawings explaining the toner-empty detection operation of an embodiment of the invention when there is a small amount of toner.

FIGS. 12A, 12B, 12C, 12D, 12E and 12F are drawings explaining the prior toner-empty detection operation when the fluidity of the toner is normal.

FIGS. 13F, 13G, 13H, 13I, 13J and 13K are drawings explaining the prior toner-empty detection operation when the fluidity of the toner is poor.

DESCRIPTION OF THE PREFERRED EMBODIMENTS

Figure 1:
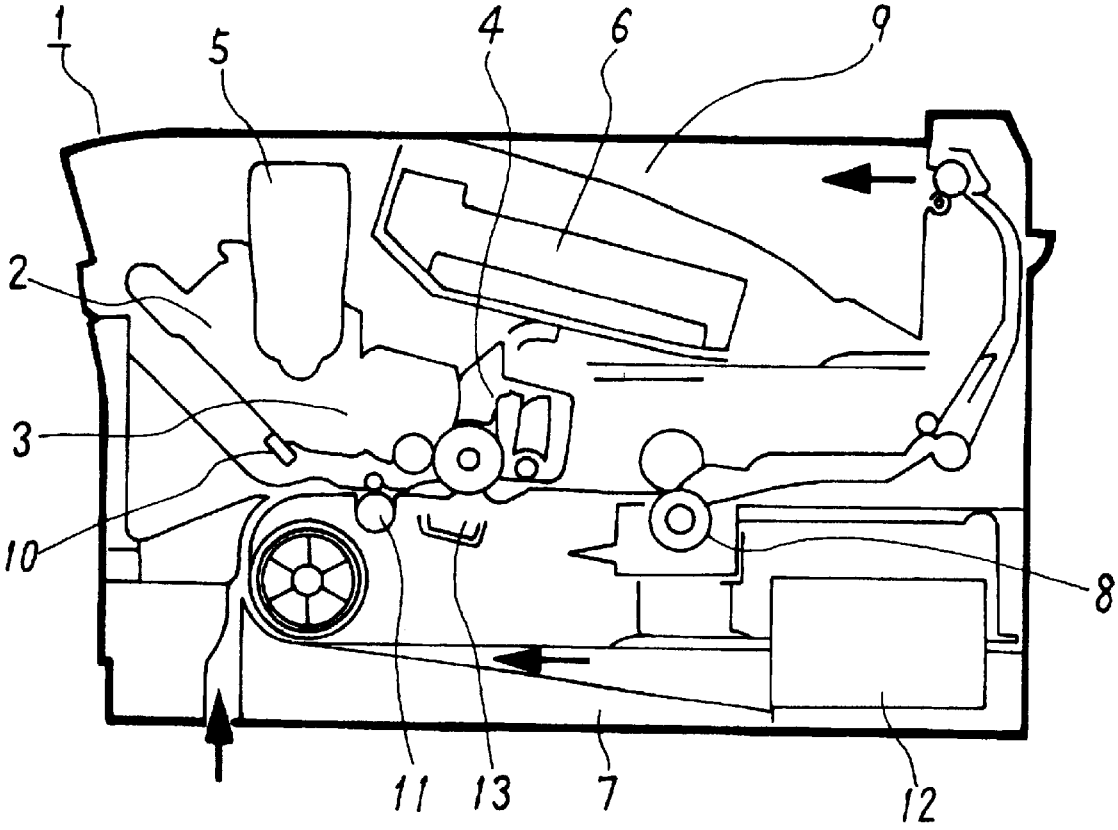
FIG. 1 is a schematic drawing of the image formation device of an embodiment of the invention.
Figure 2:
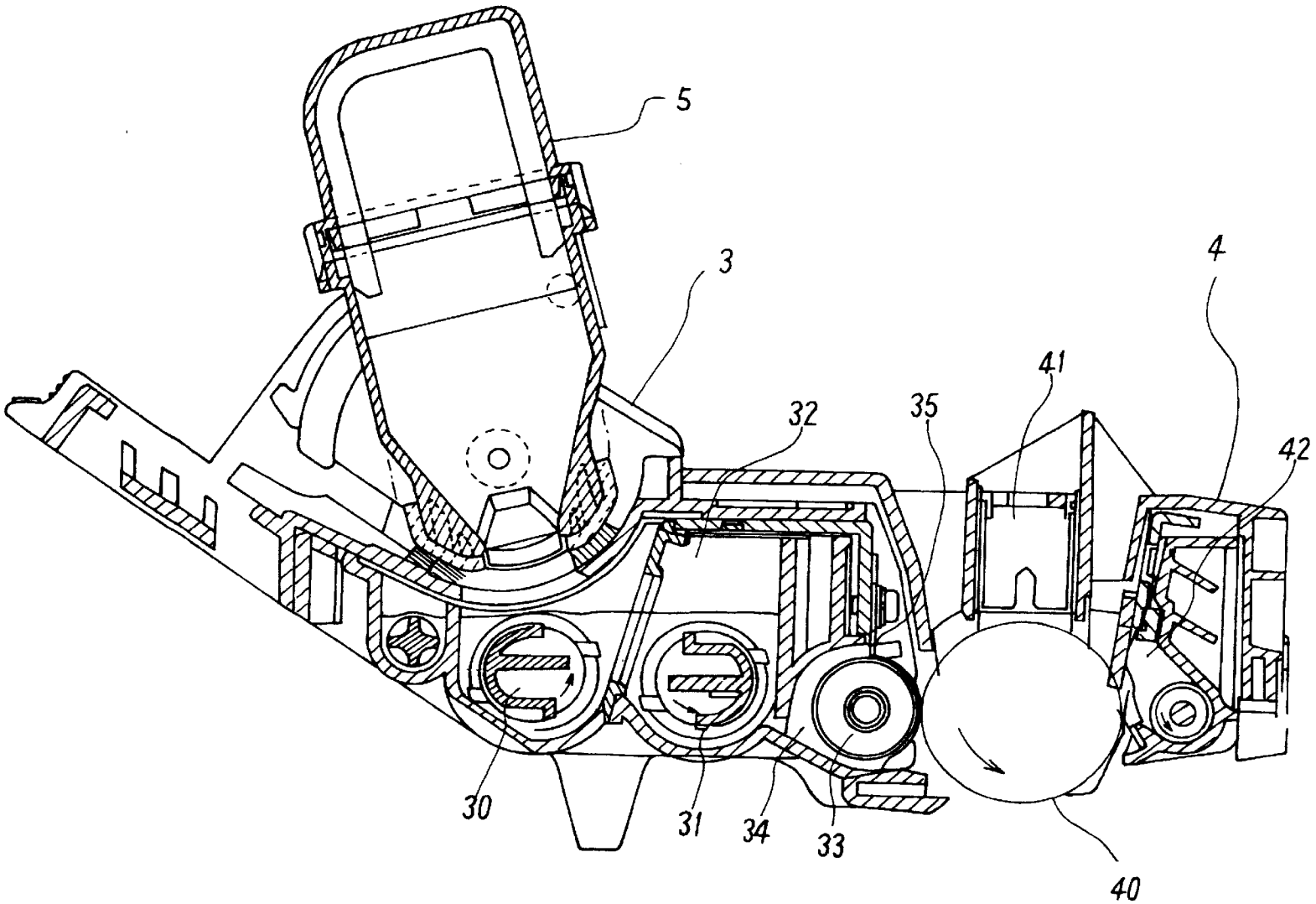
FIG. 2 is a schematic drawing of the printing unit in FIG. 1.
Figure 3:
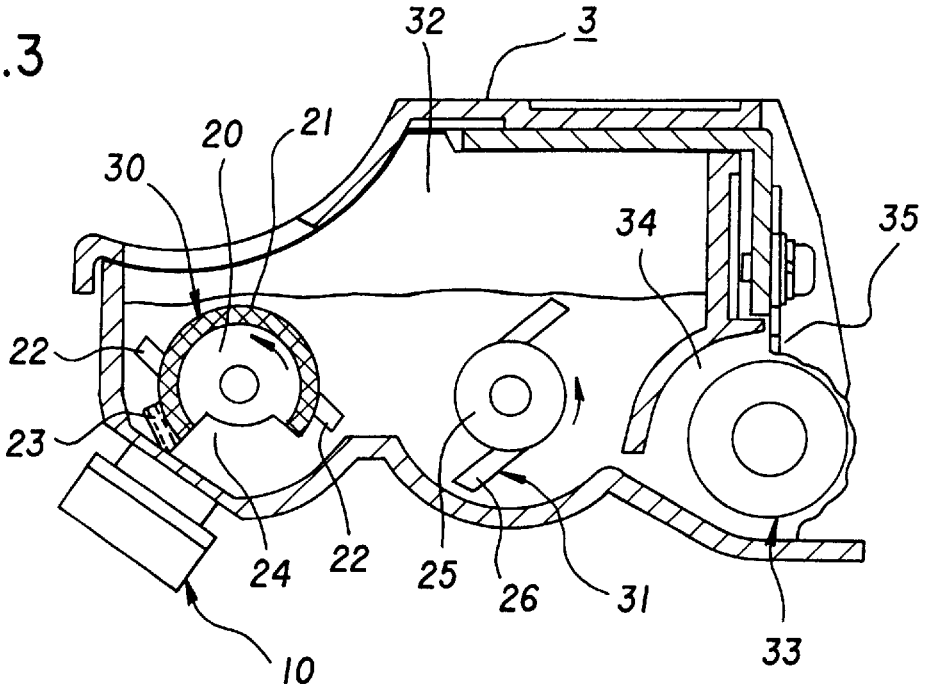
FIG. 3 is a schematic drawing of the developing unit in FIG. 2.
Figure 4A:
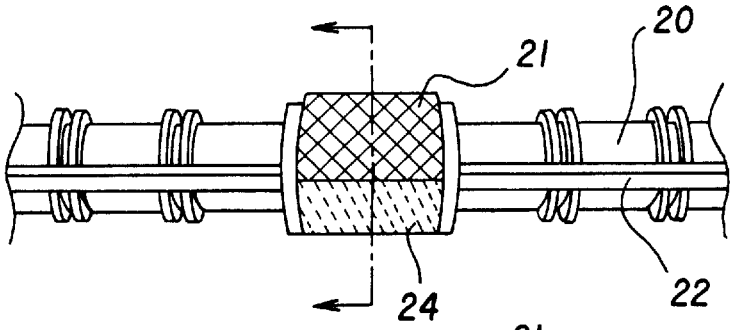
FIGS. 4A and 4B are schematic drawings of the stirring unit in FIG. 3.
Figure 4B:
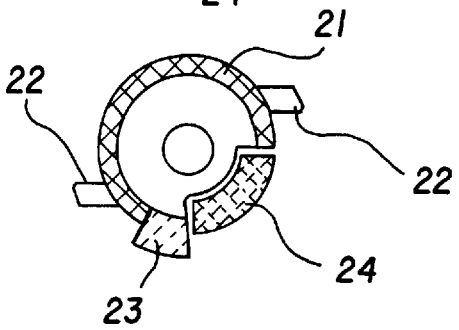
Figure 5:
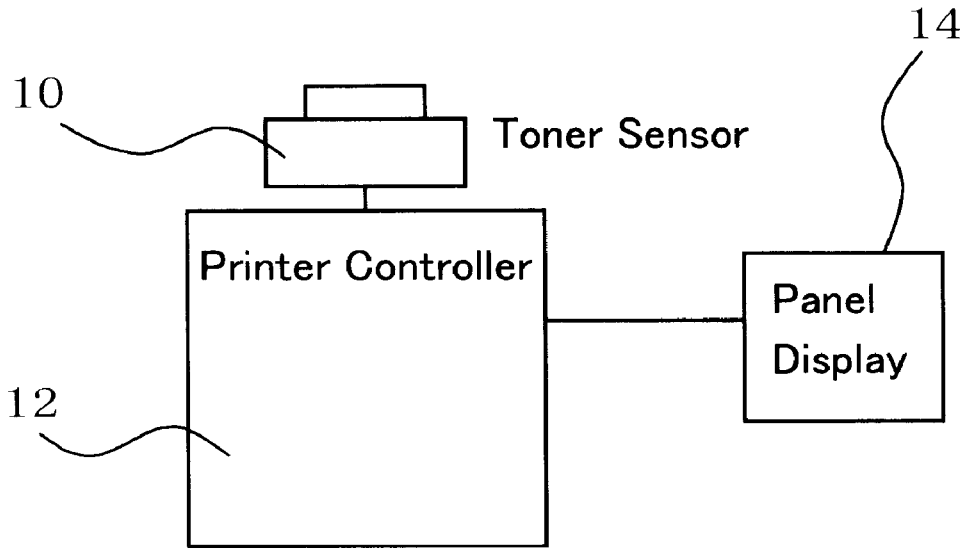
FIG. 5 is a schematic drawing of the toner-empty detection mechanism in FIG. 1.
Figure 6:
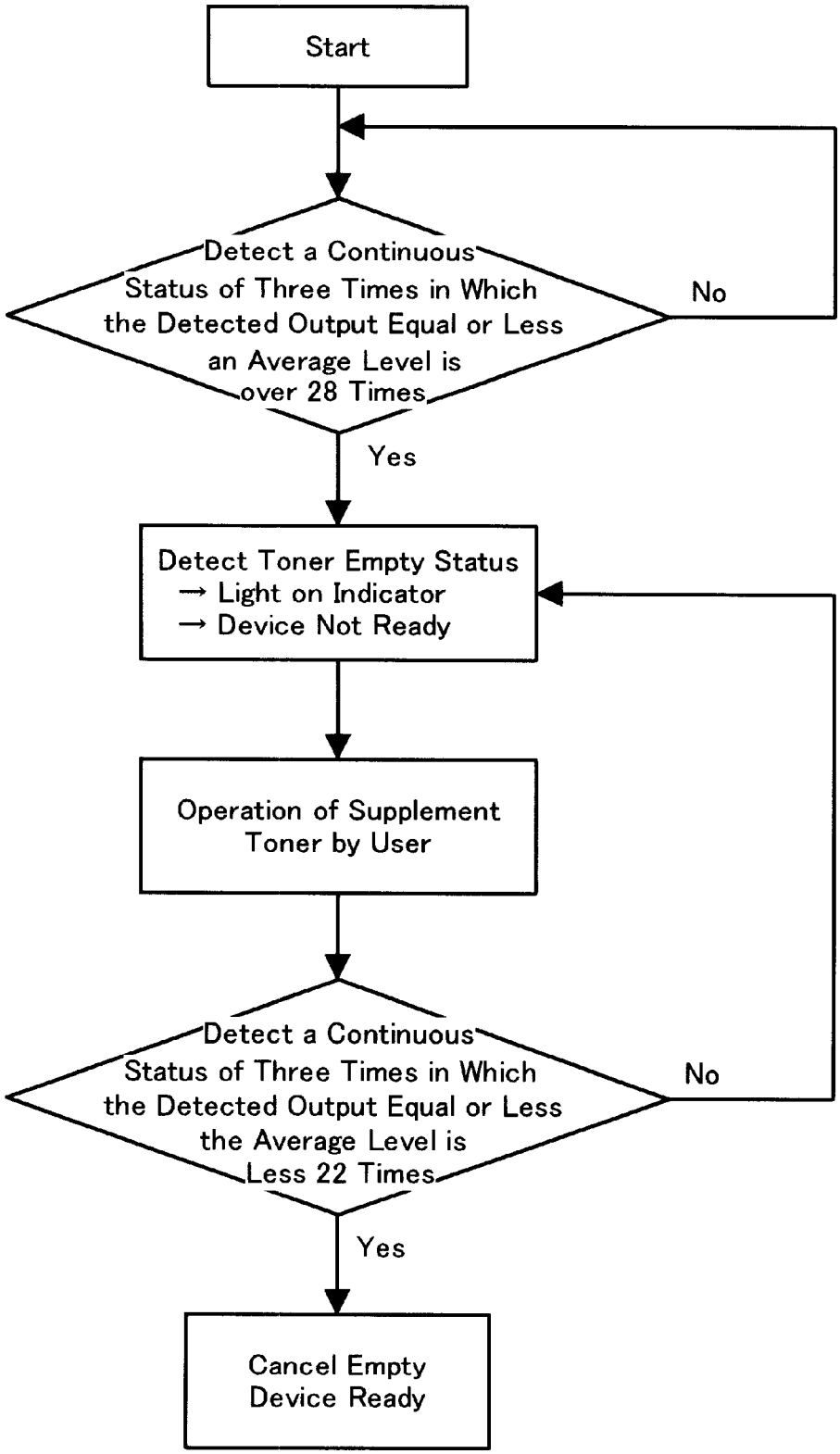
FIG. 6 is a flowchart of the toner-empty detection processing in FIG. 5.
Figure 7:
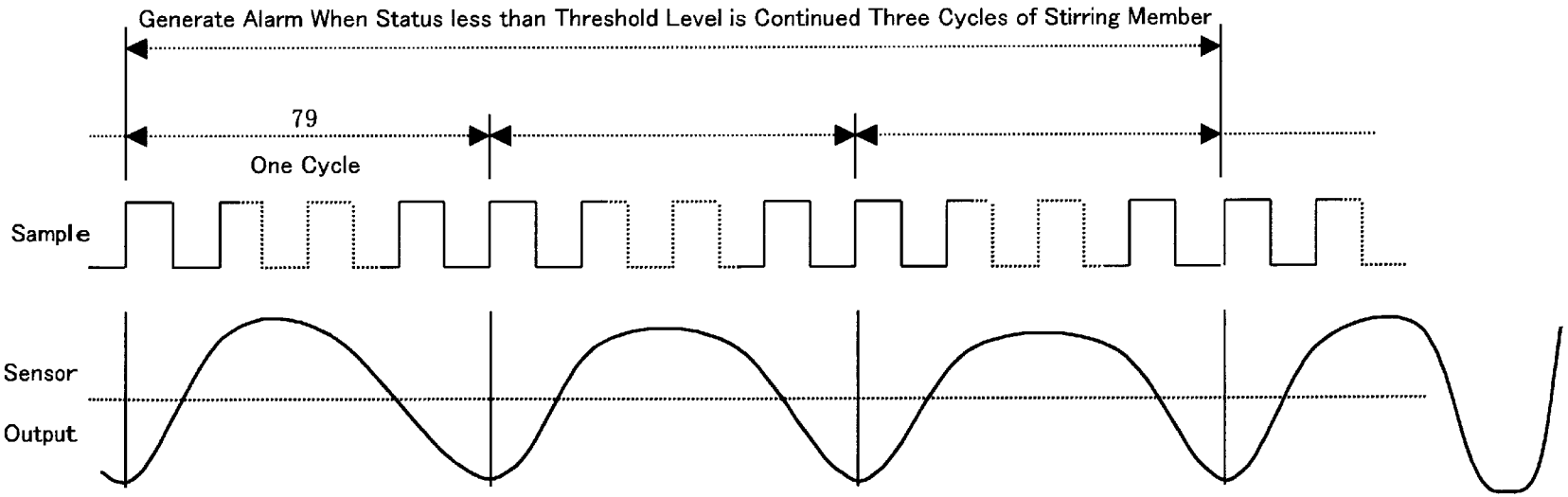
FIG. 7 is a drawing explaining the toner-empty detection operation in FIG. 5.

FIG. 1 is a schematic drawing of the image formation apparatus of an embodiment of the invention, and shows the printer device. FIG. 2 is a schematic drawing of the printing unit in FIG. 1, FIG. 3 is a schematic drawing of the developing unit in FIG. 1 and FIG. 2, FIG. 4 is a schematic drawing of the stirring unit in FIG. 3, FIG. 5 is a block diagram of the toner-empty detection system, FIG. 6 is a flowchart of the toner-empty detection process, and FIG. 7 is a drawing explaining the toner-empty detection operation.

As shown in FIG. 1, a printer 1 comprises an electrophotographic type printing unit 2, a toner bottle 5 for supplying toner to the printing unit 2, a laser optical system 6 for exposing a light image, a transfer unit 13, a paper-supply cassette, a fixation unit 8, a stacker 9, a toner sensor 10, a paper-feed roller 11 and a control circuit 12.

The printing unit 2 can be attached to or removed from the printer 1, and can be replaced. The toner bottle 5 can also be freely attached to or removed from the printing unit 2 of the printer 1, and can be replaced. The toner sensor 10 is installed in the printer 1.

As shown in FIG. 2, the printing unit 2 comprises a developing unit 3 and a drum unit 4. The developing unit 3 comprises a toner-supply compartment 32 and a developing compartment 34. In the toner-supply compartment 32, there is a pair of toner stirring units 30, 31 that stir the magnetic toner in the compartment. A developing roller 33 feeds developer, consisting of carrier and the magnetic toner, to a photosensitive drum 40 in the drum unit 4. A blade 35 regulates the height of the developer on the developing roller 33.

The drum unit 4 comprises a photosensitive drum 40, a charging unit 41 for charging the photosensitive drum 40, and a cleaning mechanism 42 for cleaning off the residual toner remaining on the photosensitive drum 40.

Before explaining the developing unit 3 in detail, the printing operation of the printer 1 in FIG. 1 and FIG. 2 is explained. The photo-sensitive drum 40 is charged by the charging unit 41, and then the light image is exposed the drum 40 by the laser optical system 6. Therefore, the electrical latent image is formed on the photosensitive drum 40. The electrical latent image on the photosensitive drum 40 is developed with toner by the developing unit 3. On the other hand, a sheet is fed from the paper-supply cassette 7. The toner image on the photosensitive drum 40 is transferred to the sheet by the transfer unit 13, to form a visible image on the sheet. The toner image on the sheet is fixed by the fixation unit 8, and then the sheet is output to the stacker 9.

As shown in FIG. 3, the developing unit 3 of the printing unit 2 comprises a toner-supply compartment 32 and a developing compartment 34. In the toner-supply compartment 32, there is a first and second toner stirring units 30, 31. The toner stirring units 30, 31 stir the magnetic toner in the toner-supply compartment 32 that is connected to the developing compartment 34, charges the toner and breaks up any hard toner. The second stirring unit 31 comprises a pair of stirring blades 26 that are located on a rotating shaft 25. This second stirring unit 31 stirs the toner as well as supplies the toner to the toner developing compartment 34.

The first toner stirring unit 30 faces a toner sensor 10 that comprises a magnetic sensor. As shown in FIG. 4A and FIG. 4B, the first stirring unit 30 comprises a rotating shaft 20, and a pair of stirring blades 22 that are located on the rotating shaft 20. In the position where the first stirring unit 30 faces the toner sensor 10, there is a magnetic metal member 21, a sensor cleaner 23, and a cut out section 24 that forms a toner accumulation. In this embodiment of the invention, there is a magnetic metal member 21 and a cut out section 24 in the stirring unit 30. The magnetic metal member 21 is made of a metal such as zinc plated steel plate or magnetic stainless steel.

As shown in FIG. 5, the printer control unit 12 has a processor such as a MPU. The control unit 12 obtains at a set period the output from the toner sensor, executes the processing shown in FIG. 6 and FIG. 7, and detects when the toner is empty, and displays a toner-empty alarm on the panel display 14.

The toner-empty detection process will be explained using FIG. 7. On rotation of the first stirring unit 30 is set as one detection period. During this detection period, the sensor output is sampled for a set period. For example, when the process velocity is 92.2 mm/s, one rotation of the first stirring unit 30 (empty detection period) is 792 ms. When sampled at a 10 ms sampling period, the number of detections per one period is 79 times. The detected value for each sample is compared with the threshold level to determine whether or not toner is detected.

This threshold level is determined as the average value of the sample values during the detection period. Moreover, the number of times that toner was not detected during one detection period is counted, and when the number of times that toner was not detected during one period is greater than the specified number of times (for example 28 times), then it is determined that there is no toner during that detection period. When this state continues for three periods, it is determined that the toner is empty. In other words, by making the threshold level equal to the average value of the previous detection period, fluctuation in relative levels is detected so variations in the output characteristics of the sensor are compensated. In addition, determining whether or not there is toner over three continuous detection periods instead of one detection period, erroneous detection is prevented even when detection is performed with a fluctuation of relative levels.

As explained with the process flowchart shown in FIG. 6, when periods, in which the detection level is below the average level 28 times or more, continue three times, then it is determined that the toner is empty, so an indicator on the panel display 14 lights up, and the device status becomes 'Not Ready'. Toner is supplied by a toner supply operation, and when periods, in which the number of times the detected level is lower than the average level 22 times or less, continue three times, the toner empty status is cleared and the device status becomes 'Ready'.

Next, the toner-empty detection operation is explained with FIG. 8 to FIG. 10. FIGS. 8F to 8K are drawings explaining the detection operation for an embodiment of the invention when fluidity of the toner is proper, and it shows the movement of the toner in FIG. 8F to FIG. 8J, and shows the detection waveform for the toner sensor in FIG. 8K. In FIG 8K, points (f) to (j) indicate the detection waveform as shaft 20 rotates. Points (f) to (j) correspond to the shaft 20 rotary positions depicted in FIG. 8F to FIG. 8J, respectively. As shown by FIG. 8F and 8G, before the sensor cleaner 23 of the stirring unit 30 passes the sensor 10, the toner flows properly from the left rear to the right, the detected waveform of the toner shows a proper detection state.

Figure 8F:
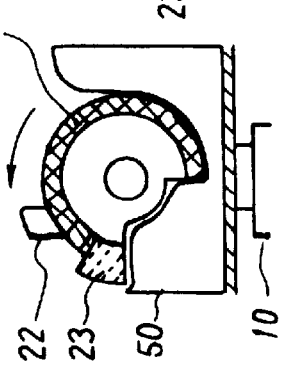
FIGS. 8F, 8G, 8H, 8I, 8J and 8K are drawings explaining the toner-empty detection operation of an embodiment of the invention when the fluidity of the toner is normal.
Figure 8G:
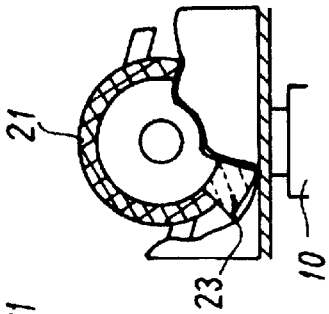
Figure 8H:
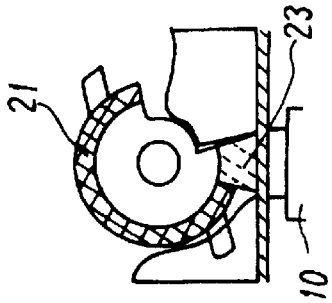
Figure 8I:
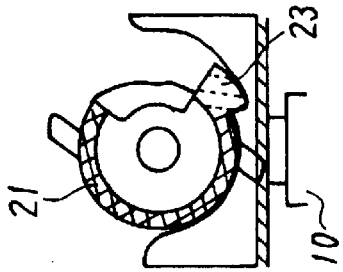
Figure 8J:
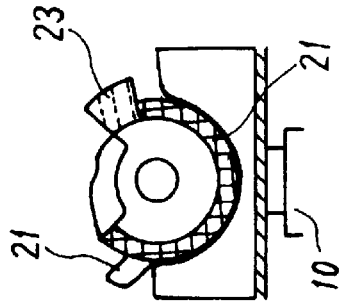
Figure 8K:
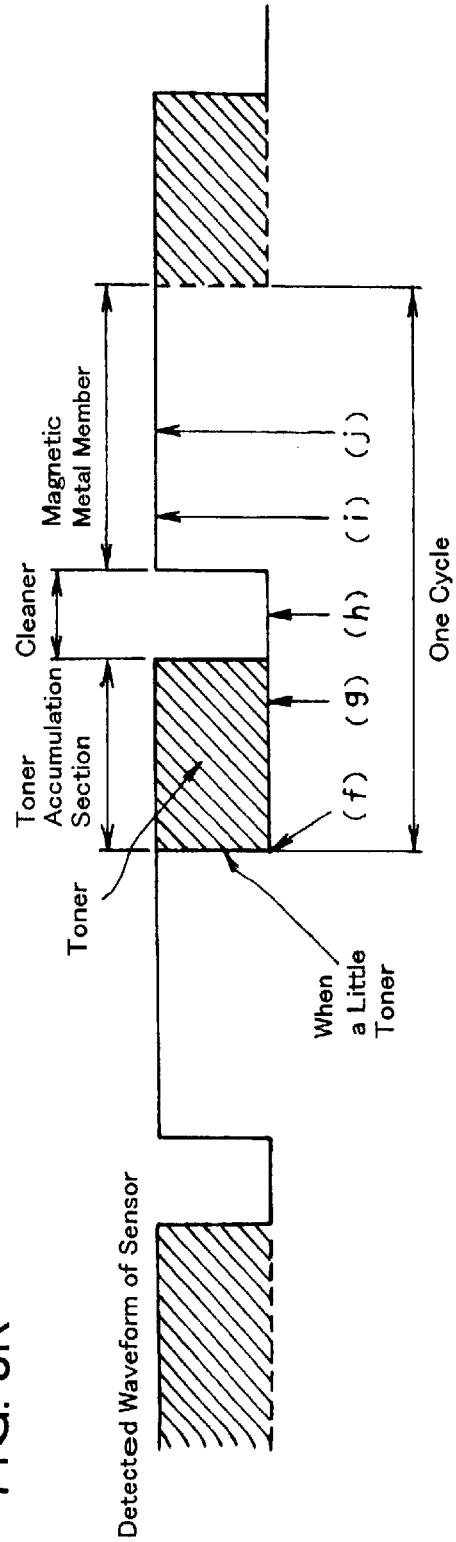

As shown in FIG. 8H, when the sensor cleaner 23 approaches the sensor 10, the sensor waveform level falls. As shown in FIG. 8I and FIG. 8J, the sensor cleaner 23 cleans the sensor 10, then toner flows to the sensor 10 and the level of the sensor output becomes high.

FIG. 9 is a drawing explaining the detection operation of an embodiment of the invention when the fluidity of the toner becomes poor, where FIG. 9A to FIG. 9F show the movement of the toner, and FIG. 9G shows the detection waveform of the toner sensor. In FIG. 9G, points (a) to (f) indicate the detection waveform as shaft 20 rotates. Points (a) to (f) correspond to the shaft 20 rotary positions depicted in FIG. 9A to FIG. 9F, respectively. FIG. 9A and FIG. 9B show the state before the sensor cleaner passes the sensor 10, where the toner 50 with poor fluidity accumulates in the toner accumulation section 24, and the level of the sensor output is high. FIG 9C shows when the sensor cleaner 23 approaches the sensor 10 and the sensor waveform level falls. As shown in FIG. 9D and FIG. 9E, the sensor 10 detects the magnetic metal member 21 even when the fluidity of the toner becomes poor, so it is possible to detect the waveform in the same way as when there is toner. In FIG. 9F, the sensor 10 accurately detects the toner 50 in the toner accumulation section 24.

FIG. 10 is a drawing explaining the detection operation of an embodiment of the invention when there is little toner remaining, where the movement of the toner is shown in FIG. 10K to 10Q, and the detection waveform of the toner sensor 10 is shown in FIG. 10R. In FIG. 10R, points (k) to (g) indicate the detection waveform as shaft 20 rotates. Points (f) to (j) correspond to the shaft 20 rotary positions depicted in FIG. 10K to FIG. 10Q, respectively. As shown in FIG. 10K and FIG. 10M, before the sensor cleaner 23 passes the sensor 10, there is only a small amount of toner, and there is no toner in the toner accumulation section 24, so the waveform level falls. As shown in FIG. 10N, the sensor cleaner 23 approaches the sensor 10 and the sensor waveform level falls. As shown in FIG. 10P and FIGS. 10Q, the sensor 10 detects the magnetic metal member 21 even when there is little residual toner, so it is possible to detect the waveform in the same way as when there is toner. Moreover, since there is no toner in the toner accumulation section 24, it is possible to accurately detect the toner-empty alarm.

In this way, by including a toner accumulation section 24 and magnetic metal member 21 in the stirring unit 30, the same sensor detection output, as when there is plenty of toner and the toner fluidity is normal, as shown in FIG. 8, can be obtained even when there is plenty of toner and the toner fluidity becomes poor, as shown in FIG. 9. Moreover, as shown in FIG. 10, it is possible to detect that toner is empty when there is only a little toner remaining.

Therefore, it is possible to prevent erroneous detection of the toner being empty when the fluidity of the toner is poor but when there is plenty of toner, and thus it is possible to prevent over supplying toner that leads to blowing or leaking of toner, and makes proper printing possible. Moreover, since the residual toner is properly managed, it is possible to use toner without waste.

Figure 11:
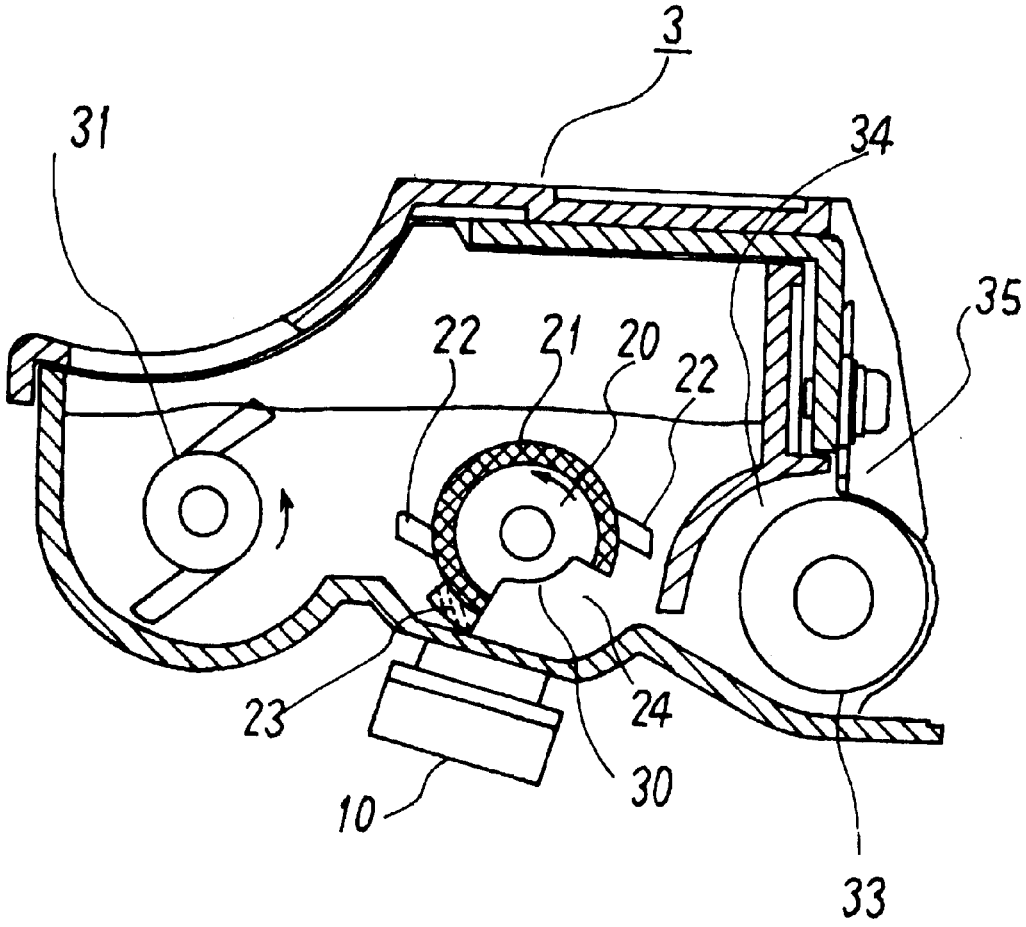
FIG. 11 is a schematic drawing of another embodiment of the invention.

FIG. 11 is a schematic drawing of another embodiment of the invention, and it shows the developing unit 3 of a printing unit 2 that is similar to that shown in FIG. 3. The toner sensor 10 is located on the side of the developing compartment 34. Therefore, the first toner stirring unit 30 is located such that it faces the magnetic sensor of the toner sensor 10. As shown in FIG. 4A, this first stirring unit 30, comprises a rotating shaft 20, and a pair of stirring blades 22 located on the rotating shaft 20. In a position facing the toner sensor 10, there is a magnetic metal member 20, a sensor unit cleaner 23, and a cut-out section 24 that forms the toner accumulation section.

This invention can be applied even when the position of the toner sensor is changed in this way. Moreover, this invention has been explained for an electro-photographic type mechanism as the image formation device, however, this invention can also be applied to other image formation mechanisms that require toner developing. Furthermore, a printing unit in which the developing unit and the drum unit are one was explained, however they may be separate, and the invention can be applied to a device in which a developing unit is installed. In addition, the toner empty judgment process can determine whether there is toner by an integral value of the sample value from one turn of the stirring unit, and detect when the toner is empty by the judgment results for one detection period. Furthermore, the invention can be applied to a toner developing device in which the toner used is a single-component magnetic toner with no carrier.

The preferred embodiments of the present invention have been explained, however the invention is not limited to these embodiments and can be embodied in various forms within the scope of the present invention.

In this invention, a magnetic metal member and toner accumulation section are provided at the position of the sensor on the stirring unit for preventing erroneous detection of the toner-empty alarm, so it is possible for the toner sensor to synthetically output that toner was detected even when fluidity of the magnetic toner becomes poor, thus making it possible to prevent erroneous detection that toner is empty. Therefore, it is possible to prevent erroneous detection of the toner-empty alarm, prevent over supply of toner, and prevent accidental blowing or leaking of the toner, making proper printing possible. Moreover, the residual toner is managed properly so it is possible to consume toner without waste.

What is claimed is:

1. An image formation apparatus comprising:

a latent image carrier;

a latent image formation unit for forming an electrical latent image on said latent image carrier;

a developing unit for developing the electrical latent image on said latent image carrier using magnetic toner; and a toner sensor for detecting whether or not there is magnetic toner in said developing unit; wherein said developing unit includes:

a toner supply chamber; and a stirring unit for stirring said magnetic toner in said toner supply chamber and comprising:

a rotary shaft:

a cleaning member provided to said rotary shaft and for cleaning a position of said toner sensor in said toner supply chamber:

a toner accumulation section provided to said rotary shaft and for accumulating said magnetic toner: and a magnetic metal member provided to said rotary shaft.

2. The image formation apparatus of claim 1 further comprising:

a control circuit for detecting a toner empty state of said toner supply chamber from outputs of said toner sensor within one rotation of said stirring unit.

3. The image formation apparatus of claim 2 wherein:

said control circuit calculates an average level of the output of said toner sensor over one rotation of said stirring unit, and detects said toner empty status by comparing the output of said toner sensor of one rotation of said stirring unit and said average level of a previous detection period.

4. The image formation apparatus of claim 1 wherein: said toner accumulation section is provided to one part around said rotary shaft, and said magnetic metal member is provided to another part around said rotary shaft.

5. The image formation apparatus of claim 4 wherein:

said cleaning member, said toner accumulation section and said magnetic metal member are arranged at positions that correspond to said toner sensor of said rotary shaft; and a stirring blade is located at another position on said rotary shaft.

6. The image formation apparatus of claim 1 wherein:

said toner supply chamber comprising a toner supply compartment; and a developing compartment connected to said toner supply compartment and having a developing roller.

7. An image formation unit, having a developing unit for developing an electrical latent image on a latent image carrier using magnetic toner, comprising:

a toner supply chamber; and a stirring unit for stirring said magnetic toner in said toner supply chamber and comprising:

a rotary shaft:

a cleaning member provided to said rotary shaft and for cleaning a position of a toner sensor in said toner supply chamber a toner accumulation section provided to said rotary shaft and for accumulating said magnetic toner: and a magnetic metal member provided to said rotary shaft.

8. The image formation unit of claim 7 wherein:

said toner accumulation section is located in one area around the rotary shaft; and said magnetic metal member is located in another area around the rotary shaft.

9. The image formation unit of claim 8 wherein:

said cleaning member, said toner accumulation section and said magnetic metal member are arranged at position that correspond to said toner sensor of said rotary shaft; and a stirring blade is located at another position on said rotating shaft.

10. The image formation unit of claim 7 further comprising said latent image carrier.

11. The image formation unit of claim 7 wherein:

said toner supply chamber comprising a toner supply compartment; and a developing compartment connected to said toner supply compartment and having a developing roller.

12. A toner stirring unit for a developing device, that develops a latent image on an latent image carrier with magnetic toner, comprising:

a rotary shaft:

a cleaning member provided to said rotary shaft and for cleaning a position of a toner sensor in said toner supply chamber:

a toner accumulation section provided to said rotary shaft and for accumulating said magnetic toner: and a magnetic metal member provided to said rotary shaft.

13. The toner stirring unit of claim 12 wherein:

said toner accumulation section is located in one area around the rotary shaft; and said magnetic metal member is located in another area around the rotary shaft.

14. The toner stirring unit of claim 12 wherein:

said cleaning member, said toner accumulation section and said magnetic metal member are arranged at positions that correspond to said toner sensor of said rotary shaft;

and a stirring blade is located at another position on said rotating shaft.

* * * * *